US009676180B2

(12) United States Patent
Gracia Verdugo et al.

(10) Patent No.: US 9,676,180 B2
(45) Date of Patent: Jun. 13, 2017

(54) PRINTHEAD ALIGNMENT CORRECTION

(71) Applicant: Hewlett-Packard Development Company, L.P., Houston, TX (US)

(72) Inventors: Antonio Gracia Verdugo, Barcelona (ES); Barret Kammerzell, Barcelona (ES); Joan Albert Jorba Closa, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/787,464

(22) PCT Filed: Aug. 13, 2013

(86) PCT No.: PCT/EP2013/066915
§ 371 (c)(1),
(2) Date: Oct. 27, 2015

(87) PCT Pub. No.: WO2015/022018
PCT Pub. Date: Feb. 19, 2015

(65) Prior Publication Data

US 2016/0107435 A1 Apr. 21, 2016

(51) Int. Cl.
*B41J 2/045* (2006.01)
*B41J 2/21* (2006.01)
(Continued)

(52) U.S. Cl.
CPC ..... *B41J 2/04505* (2013.01); *B41J 2/04563* (2013.01); *B41J 2/04586* (2013.01);
(Continued)

(58) Field of Classification Search
CPC .. B41J 2/04505; B41J 2/04586; B41J 2/2135; B41J 2/04563; B41J 25/001; B41J 2/365
See application file for complete search history.

(56) References Cited

U.S. PATENT DOCUMENTS 6,398,333 B1 6/2002 Mulay et al.
6,775,022 B2 8/2004 Noyes et al.
(Continued)

FOREIGN PATENT DOCUMENTS

EP 0605207 7/1994
EP 0606022 7/1994
EP 2213455 8/2010

OTHER PUBLICATIONS

Machine translation of JP 2014-073658 A. (JP 2014-073658 A was published on Apr. 24, 2014.).*
(Continued)

*Primary Examiner* — Justin Seo
(74) *Attorney, Agent, or Firm* — HP Inc.—Patent Department

(57) ABSTRACT

Herein, techniques are described for printing an image on a print media by operation of a printhead to eject a print fluid over the print media. In at least some examples, a printhead temperature parameter is acquired, the parameter being indicative of a temperature at the printhead during printing; alignment of the printhead is corrected based on the printhead temperature parameter; printing is performed on the print media via the printhead according to the corrected alignment.

18 Claims, 5 Drawing Sheets

(51) Int. Cl.
*B41J 2/365* (2006.01)
*B41J 25/00* (2006.01)

(52) U.S. Cl.
CPC ..... *B41J 2/2135* (2013.01); *B41J 2/365* (2013.01); *B41J 25/001* (2013.01)

(56) References Cited

U.S. PATENT DOCUMENTS

| | | | | |
|---|---|---|---|---|
| 7,455,390 | B2 | 11/2008 | Silverbrook | |
| 2009/0295858 | A1* | 12/2009 | Ito | B41J 2/0456 347/17 |
| 2009/0303274 | A1 | 12/2009 | Iwata et al. | |
| 2015/0202867 | A1* | 7/2015 | Koga | B41J 2/155 347/14 |

OTHER PUBLICATIONS

Bruijnen, Dennis, et al. "Design of a printhead alignment sensor for a temperature varying environment." American Control Conference, Feb. 22, 2006. IEEE, 6 pp.

PCT International Search Report and Written Opinion, Apr. 10, 2014, European Patent Office, PCT Application No. PCT/EP2013/066915, 9 pages.

* cited by examiner

PRINTHEAD ALIGNMENT CORRECTION

CROSS-REFERENCE TO RELATED APPLICATION

This application is a U.S. National Stage Application of and claims priority to International Patent Application No. PCT/EP2013/066915, filed on Aug. 13, 2013, and entitled "PRINTHEAD ALIGNMENT CORRECTION," which is hereby incorporated by reference in its entirety.

BACKGROUND

Some printing systems, commonly referred to as inkjet printers, form a printed image by ejecting print fluids from printheads. Print fluids may include inks and or other print fluids (e.g., a pre-treatment or a post-treatment print fluid that facilitate improving quality or durability of a printed pattern). Thereby, a print fluid is applied onto a print medium for printing a pattern of individual dots positioned at specific locations. The printed pattern reproduces an image on the printing medium.

For facilitating a sufficient print quality, the printheads have to be correctly aligned with respect to the print medium. If a printhead is misaligned, the individual dots might not be printed at the desired locations. Although printhead misalignment might affect print quality for a variety of print modes, it might be particularly relevant for bidirectional printing. In bidirectional printing, in which print fluids are ejected while the printhead is travelling in a forward and a reverse direction, printhead misalignment might particularly affect print quality since the misalignment would result in a mismatch between dots printed in the forward direction and dots printed in the reverse direction.

BRIEF DESCRIPTION OF THE DRAWINGS

In order that the present disclosure may be well understood, various examples will now be described with reference to the following drawings.

DETAILED DESCRIPTION

Figure 1:
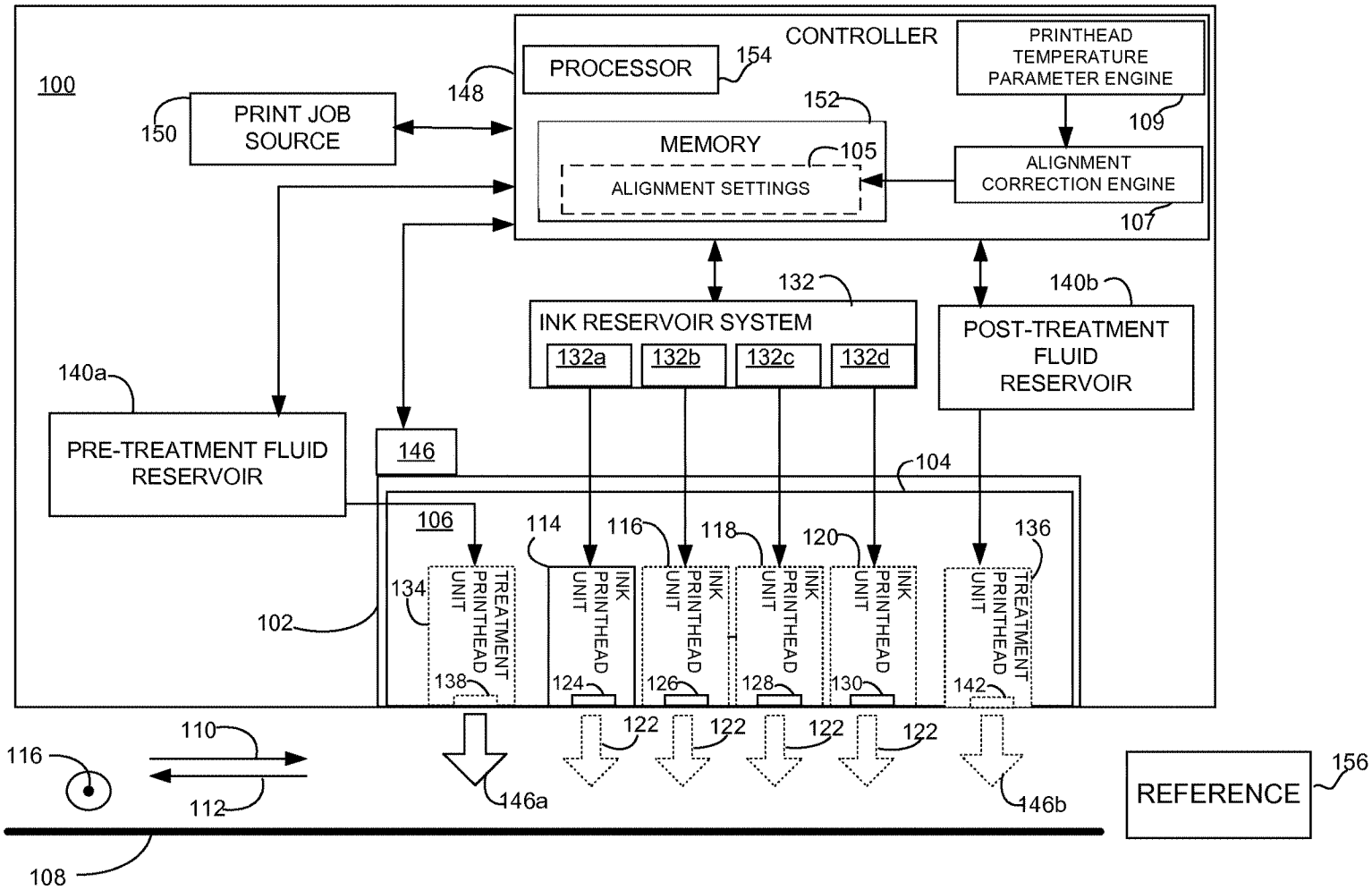
FIG. 1 is a block diagram schematically illustrating a printing system in which examples can be implemented.

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Similar or equal elements in the Figures may be indicated using the same numeral.

As set forth above, printhead alignment might affect print quality of an inkjet printer for a variety of print modes. Therefore, at least some inkjet printers implement automatic alignment of the printheads. This might be performed by printing a test pattern; measuring placement of dots in the test pattern to determine printhead misalignment; and correct printhead misalignment based on the dots placement in the test pattern. Alignment setting might be thereby generated that indicate when nozzles in the printhead are to be fired in order to prevent misplacement of print fluids on the print media. Images are then printed considering the predetermined alignment settings.

As used herein, printhead alignment refers to the correlation between the position where nozzles in the printhead are fired and drop placement on the media. Printhead alignment may vary during printing of an image. Printhead alignment variation may be due to a variety of factors and may affect the relative position between a printhead and the print media and/or print fluid drop ejection speed (which also affects positioning of drops on media).

A printhead temperature variation may cause changes in printhead alignment during printing. For example, a printhead temperature increase may be caused by several factors such as the amount of print fluid to be ejected, the firing frequency of the printhead, the printing mode, print fluid density, printer status (e.g., latex printers might be in a curing ink status), how long firing is sustained, length of print swaths, or the ambient conditions. The amount of temperature increase may in particular translate into changes in bidirectional dot placement errors, although it also affects quality in other print modes. Bidirectional dot placement errors may cause different, visible print quality problems such as graininess or edge roughness.

In at least some of the examples herein, misalignment during printing is addressed by acquiring a printhead temperature parameter indicative of a temperature at the printhead during printing (i.e., while an image is being printed without necessarily implying that the printhead is being operated while the parameter is being acquired). Alignment of the printhead with respect to the print media is corrected based on the printhead temperature parameter. Printing is performed on the print media via the printhead according to the corrected alignment. Such a misalignment correction might be performed dynamically, i.e. it might be performed during printing of an image. Moreover, misalignment correction might be performed multiple times during printing of an image to facilitate the same print quality in different image portions.

As used herein, a printhead temperature parameter refers to a parameter that is correlated to the temperature at the printhead. There are a variety of parameters that have a reciprocal relation with printhead temperature. For example, the print fluid amount to be ejected by the printhead to print at least an image portion is correlated to the printhead temperature and might be used as printhead temperature parameter. In other examples, the printhead temperature parameter might be a printhead temperature measured via a sensor.

The temperature acquisition may be predictive. For example, a print fluid amount to be ejected by the printhead to print at least an image portion might be estimated. As mentioned above, this print amount might be used as the printhead temperature parameter since temperature increases are correlated to the amount of print fluid to be ejected by the printhead.

Alternatively, or in addition thereto, the temperature acquisition may be reactive, i.e., based on actual temperature values. For example, a printhead temperature value from a temperature sensor might be used as the printhead temperature parameter.

The following description is broken into sections. The first, labeled "Environment," describes environments in which examples may be implemented. The second section, labeled "Components," describes various physical and logical components for implementing various examples. The third section, labeled as "Operation," describes steps taken to implement various embodiments.

ENVIRONMENT: FIG. 1 is a block diagram of a printer 100, in which examples can be implemented. It will be understood that the following description of printer 100 is merely illustrative and does not limit the components and functionality of examples described in the present disclosure.

As shown in the diagram, printer 100 includes a carriage 102 with a printhead receiving assembly 104. In the illustrated example, printer 100 is illustrated including printhead 106 in printhead receiving assembly 104. Carriage 102 is to transition printhead 106 across the width of a print media 108, i.e., along printhead transition directions 110, 112. For example a drive 146 may be coupled to carriage 102 for effecting carriage transition. Thereby, printer 100 can perform printing across a width of print media 108 via translation of carriage 102.

Printhead 106 in this example is illustrated to include a plurality of ink printhead units 114, 116, 118, 120. Each of the ink printhead units is configured to eject ink 122 of a different color via respective ink nozzle array arrangement 124, 126, 128, 130 Ink printhead units 114, 116, 118, 120 are fluidly connected to an ink reservoir system 132. Ink reservoir system 132 includes ink reservoirs 132*a*, 132*b*, 132*c*, 132*d* for providing ink to the respective ink printhead units. In the illustrated example, ink reservoirs 132*a*, 132*b*, 132*c*, 132*d* respectively store cyan ink, magenta ink, yellow ink, and black ink.

Base colors may be reproduced on print media 108 by depositing a drop of one of the above mentioned inks onto a print media location. Further, secondary colors can be reproduced by combining ink from different ink printhead units. In particular, secondary or shaded colors can be reproduced by depositing drops of different base colors on adjacent dot locations in the print media location (the human eye interprets the color mixing as the secondary color or shading). It will be understood that further ink reservoirs may be provided. For example, a CcMmKY system may include further ink reservoirs for light cyan (c) and light magenta (m).

According to some examples herein, printer 100 may include at least one printhead unit for ejecting a pre-treatment fluid 146*a* and/or at least one printhead unit for ejecting a post-treatment fluid 146*b*. In the example of FIG. 1, treatment printhead units 134, 136 are for treating a print media location. Treatment printhead unit 134 is for applying a pre-treatment 146*a* (e.g., a fixer) on the print media location via a pre-treatment nozzle set 138. More specifically, in at least some examples herein, a treatment fluid to be deposited is a fixer. A fixer fluid may be configured as described in U.S. Pat. Nos. 4,694,302, 5,746,818, or 6,132,021, which are incorporated by reference.

Treatment printhead unit 134 is for applying a post-treatment 146*b* (e.g., a coating) on the print media location via a post-treatment nozzle set 142. A post-treatment may be as described by US patent application with application Ser. No. 12/383066 published under publication number US 2012/0120142.

The block diagram in FIG. 1 shows treatment printhead units 134, 136 fluidly connected to, respectively, a pre-treatment fluid reservoir 140*a* and a post-treatment fluid reservoir 140*b*. Treatment fluid reservoirs 140*a*, 140*b* are to store the treatment fluid to be jetted by treatment nozzles 138, 142. For example, pre-treatment fluid reservoir 140*a* may store a printing fluid including an ink fixer component; post-treatment fluid reservoir 140*b* may store a printing fluid including a coating component.

Ink reservoir system 132 and treatment fluid reservoirs 140*a*, 140*b* may include disposable cartridges (not shown). The reservoirs may be mounted on carriage 102 in a position adjacent to the respective printhead. In other configurations (also referred to as off-axis systems), the reservoirs are not mounted on carriage 102 and a small fluid supply (ink or treatment) is externally provided to the printhead units in carriage 102; main supplies for ink and fixer are then stored in the respective reservoirs. In an off-axis system, flexible conduits are used to convey the fluid from the off-axis main supplies to the corresponding printhead cartridge. Printheads and reservoirs may be combined into single units, which are commonly referred to as "pens".

It will be appreciated that examples can be realized with any number of printhead units depending on the design of the particular printing system, each printhead unit including a nozzle array for jetting a printing fluid such as ink or treatment. For example, printer 100 may include at least one treatment printhead unit, such as two or more treatment printhead units. Furthermore, printer 100 may include at least one ink printhead unit, such as two to six ink printhead units, or even more ink printhead units.

In the illustrated examples, ink printhead units are located at one side of a treatment printhead. It will be understood that ink printheads may be located at both sides of a treatment printhead. Further, printhead units might be monolithically integrated in printhead 106. Alternatively, each printhead unit might be modularly implemented in printhead 106 so that each printhead unit can be individually replaced. Further, printhead 106 may be a disposable printer element or a fixed printer element designed to last for the whole operating life of printer 100.

The relative alignment of any of the printhead units in carriage 102 with respect to print media 108 or, more specifically, with respect to a stationary reference 156, may vary due to a number of factors such as manufacturing tolerance, positioning of the printhead in the carriage, or thermal variations. From those factors, thermal variation due to a change in the printhead temperature may affect alignment during printing of an image.

Printer 100 further includes a controller 148, which is operatively connected to the above described elements of printer 100. Controller 148 is shown configured to execute a print job received from a printjob source 150.

Controller 148 is shown to include processor 154. Processor 154 is configured to execute methods as described herein. Processor 154 may be implemented, for example, by one or more discrete processing units (or data processing components) that are not limited to any particular hardware, firmware, or software (i.e., machine readable instructions) configuration. Processor 154 may be implemented in any computing or data processing environment, including in digital electronic circuitry, e.g., an application-specific integrated circuit, such as a digital signal processor (DSP) or in computer hardware, firmware, device driver, or software (i.e., machine readable instructions). In some implementations, the functionalities of the modules are combined into a single data processing component. In other versions, the respective functionalities of each of one or more of the modules are performed by a respective set of multiple data processing components.

Memory device 152 is accessible by controller 148 and, more specifically, by processor 154. Memory device 152 may be integrated within controller 148 or may be a separate component communicatively connected to controller 148. Memory device 152 stores process instructions (e.g., machine-readable code, such as computer software) for implementing methods executed by controller 148 and, more specifically, by processor 154.

Program instructions in memory device 152 may be part of an installation package that can be executed by processor 154 to implement control engine 108. In this case, memory 152 may be a portable medium such as a CD, DVD, or flash drive or a memory maintained by a server from which the installation package can be downloaded and installed. In another example, the program instructions may be part of an application or applications already installed. Here, memory 152 can include integrated memory such as a hard drive. It should be noted that a tangible medium as used herein is considered not to consist of a propagating signal and rather being of non-transitory nature, e.g., at least for the operating lifetime of the medium.

Figure 7:
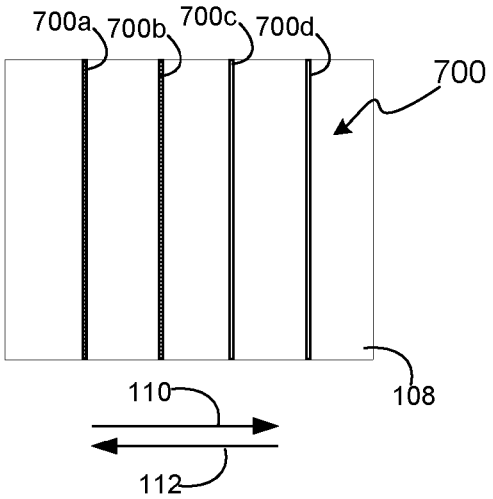
FIG. 7 is a block diagram illustrating printer operation according to examples herein.

Controller 148 receives printjob commands and data from printjob source 150, which may be a computer or any other source of printjobs, in order to print an image based on a print mask. A print mask refers to logic that includes control data determining which nozzles of the different printheads are fired at a given time to eject fluid in order to reproduce a printjob. The print mask may be processed according to alignment settings 105 by processor 154 in order to cause ejection of print fluids according to a selected printhead alignment. Alignment settings 105 may be default alignment data for printer 100, alignment data manually entered, or data automatically generated by an initial alignment procedure as illustrated below with respect to FIG. 7.

In an example, alignment data 105 forms part of a print mask supplied by print job source 150. Alternatively, alignment data 105 might be implemented in the print mask by a pre-processing performed by processor 154, or any other processor, so that printing is performed on print media 108 according to the selected alignment. In a specific example, alignment data 105 is stored in a data file (e.g., an xml file) accessible by controller 148 to determine how nozzles in the printheads are to be fired for compensating a printhead misalignment.

In the illustrated example, controller 148 includes an alignment correction engine 107 to correct printhead alignment based on a printhead temperature parameter. Thereby, alignment correction engine 107 may modify alignment settings 105 for correcting printhead alignment to take into account alignment variations caused by changes in printhead temperature. Thereby, printing of at least a portion of an image may be performed according to the corrected printhead alignment. For example, alignment settings 105 may access a file where alignment settings 105 is stored. Alignment settings 105 may be corrected by re-writing or adding alignment values in the file. Controller 148 may control printing of the image, or a portion thereof, according to the corrected alignment data. More specific examples of alignment correction engine 107 are set forth below with respect to FIGS. 3 and 4.

A printhead temperature parameter engine 109 may provide values of a printhead temperature parameter to alignment correction engine 107 so that it can estimate whether alignment correction, and the amount thereof, is required. Printhead temperature parameter engine 109 may provide printhead temperature parameter values from measurements of a temperature sensor (shown in FIG. 2). In other examples, the printhead temperature parameter is another print parameter that is correlated to printhead temperature. For example, printhead temperature parameter engine 109 may provide as printhead temperature parameter a print fluid density counting function. The print fluid density counting function provides an estimate of the amount of print fluid to be ejected by the printhead to print the image portion. As set forth above, the temperature at a printhead is correlated to a print fluid amount to be ejected therefrom. A print fluid density counting function may be derived from the print mask generated by print job source 150. In some examples, print job source may be provided as part of an ASIC and the density counting function may be implemented as a programmed function in the ASIC. More specific examples of printhead temperature parameter engine 109 are set forth below with respect to FIGS. 3 and 4.

Controller 148 is operatively connected to treatment printhead units 134, 136, ink printhead units 114, 116, 118, 120, and the respective reservoirs to control, according to the print mask and the control data in memory 152. Thereby, controller 148, and more specifically processor 154, can control functionality of printer 100 such as, but not limited to performing printing according to alignment settings 105.

It will be understood that the functionality of memory 152 and print job source 150 might be combined in a single element or distributed in multiple elements. Further, controller 148, or elements thereof, may be provided as external elements of print system 100. Further, it will be understood that operation of processor 154 for printhead alignment is not limited to the example of FIG. 1.

Figure 2:
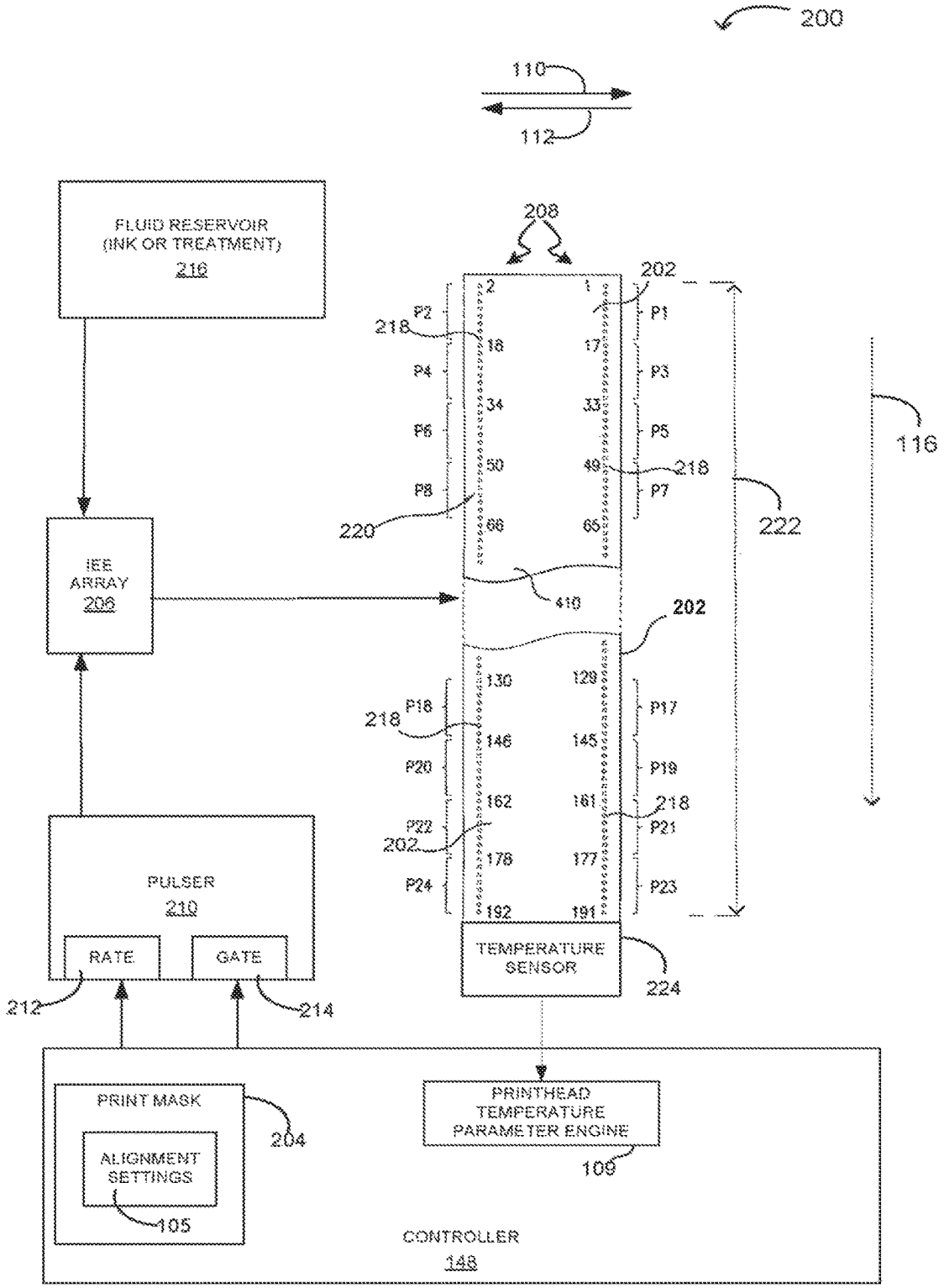
FIG. 2 is a block diagram schematically illustrating a portion of the printing system of FIG. 1.

FIG. 2 is a block diagram of a portion 200 of printing system 100 illustrating an example of printhead firing control. The example is illustrated for a printhead 202, which may correspond to a treatment printhead (e.g., corresponding to any of treatment printheads units 134, 136) or to an ink printhead (e.g., any of ink printheads 114, 116, 118, 120). Controller 148 may provide a print mask 204 to a pulser 210. Print mask 204 is built according to alignment settings 105. Pulser 210 may be located on or off printhead 202 depending on the particular printing system. Pulser 210 may process data from print mask 204 to generate pulses that controls an ink ejection element (IEE) array 206 associated to nozzle array 208. IEE array 206 includes IEEs (not shown) operatively coupled to a nozzle or a group of nozzles in nozzle array 208. In the illustrated example, controller 148 provides firing data to pulser 210 on two lines: i) a rate line 212 for setting the pulse rate; and ii) a gate line 214 for setting which pulses are to be forwarded to a particular IEE. Electrodes (not shown) on carriage 102 (see FIG. 1) may forward the pulses.

The particular fluid ejection mechanism within the printhead may take on a variety of different forms such as those using piezo-electric or thermal printhead technology. For example, if the fluid ejection mechanism is based on a thermal printhead technology, the pulses forwarded to an IEE of IEE array 206 may be forwarded as a current pulse that is applied to a resistor within the particular IEE. The current pulse causes a fluid droplet (not shown), formed with fluid (i.e., ink or treatment fluid) from a fluid reservoir 216 (e.g., ink reservoir 132*a*-132*d* or treatment fluid reservoir 140*a*, 140*b*), to be ejected from the nozzle associated with the particular IEE.

FIG. 2 further illustrates a particular arrangement of a printhead 202. The depicted elements of printhead 202 are not to scale and are exaggerated for simplification. Printhead 202 includes nozzle array 208 formed by individual nozzles 218. Nozzles 218 may be of any size, number, and pattern.

A fluid ejection chamber (not shown) may be located behind nozzles 218 and contains IEEs associated to nozzles 218. A specific group of nozzles (hereinafter referred to as a primitive 220) may be allocated for being fired simultaneously. Nozzle array 208 may be arranged into any number of multiple subsections with each subsection having a particular number of primitives operated by a particular number of IEEs. In the illustrated example, printhead 202 has 192 nozzles with 192 associated firing IEEs; the 192 nozzles (nozzles 1 to 192) are allocated in 24 primitives (primitives P1 to P24) arranged in two columns of 12 primitives each.

The length of the rows of nozzles along the media advance direction defines a print swath 222. In this example, the width of this band along media advance direction 116 defines the "swath width," i.e. the maximum pattern of print fluid which can be laid down in a single transition of carriage 102. As set forth above, a print swath may also refer to what is printed in multiple passes of a printhead over the media before the media is advanced to print an outstanding pass, or, in a non-scanning, page-wide printer, to the area printable over the print media by a single operation of the non-scanning printhead.

In the example illustrated in FIG. 2, a temperature sensor 224 is provided at printhead 202 for measuring a printhead temperature. For example, temperature sensor 224 may be configured to measure temperature at a surface 226 where nozzles 218 are provided. The printhead temperature parameter used to correct printhead alignment and, thereby, generate alignment settings 105 may corresponds to the sensor measurement from sensor 224. It will be understood that there are a variety of options for implementing temperature sensor 224. For example, temperature sensor 224 may be a thermocouple or resistor transducer provided at surface 226 that provides a voltage correlated to printhead temperature. Such a voltage might be then used as the printhead temperature parameter described herein. It will be understood that there are a variety of options for implementing a printhead temperature sensor. Generally, any suitable temperature transducing element that provides a sensor reading indicative of temperature at printhead 202 may be used to implement temperature sensor 224.

Components: At least some of the functionality described herein can be implemented as components comprised of a combination of hardware and programming configured for performing tasks described herein (for example, blocks in the flow charts illustrated below with respect to FIGS. 4 and 5). Examples of such components include alignment correction engine 107 and printhead temperature parameter engine 109 depicted in FIG. 1 as well as components in FIG. 3.

Figure 3:
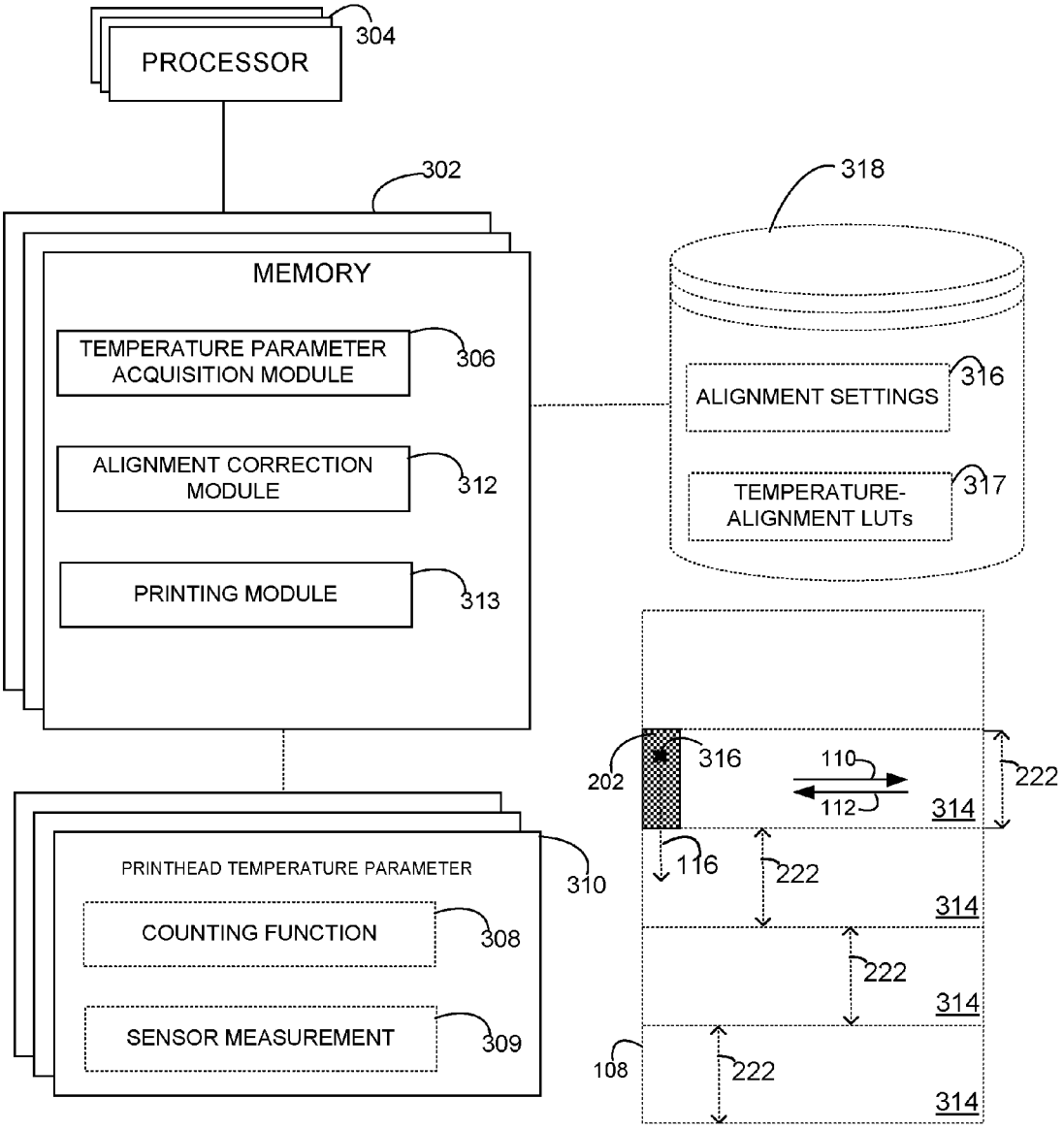
FIG. 3 is a block diagram schematically illustrating components for implementing examples.

FIG. 3 depicts examples of physical and logical components for implementing at least some of the examples illustrated herein. In illustrating FIG. 3, reference is made to printer 100 in FIG. 1 and the components in FIG. 2. It will be understood that this reference is merely illustrative and does not limit components of examples herein.

In the example of FIG. 3, the programming may be processor executable instructions stored on a tangible memory media 302, e.g., memory 152 depicted in FIG. 1, and the hardware may include processor 304, which might be implemented by processor 154 depicted in FIG. 1, for executing those instructions. Memory 302 can be said to store program instructions that when executed by processor 304 implements, at least partially, controller 148 shown in FIG. 1. Memory 302 may be integrated in the same device as processor 304, e.g. such as illustrated in FIG. 1 with memory 152 and processor 154 forming part of controller 148, or it may be separate but accessible to that device and processor 304. Memory 302 and processor 304 may be respectively comprised of single, integrated components or may be distributed over a number of discrete memory units and processor units. Such discrete memory units and processor units may be included in the same integrated component (e.g., controller 148) or may be distributed over different, communicatively connected, components (e.g., a controller comprised of multiple discrete components).

Program instructions in memory 302 may be part of an installation package that can be executed by processor 304 to implement examples herein. In this case, memory 304 may be a portable medium such as a CD, DVD, or flash drive or a memory maintained by a server from which the installation package can be downloaded and installed. In another example, the program instructions may be part of an application or applications already installed. Here, memory 302 can include integrated memory such as a hard drive. It should be noted that a tangible medium as used herein is considered not to consist of a propagating signal. In examples, the medium is a non-transitory medium.

In FIG. 3 the executable program instructions stored in memory 302 are depicted as a temperature parameter acquisition module 306, an alignment correction module 312 and a printing module 313. It will be understood that these modules may be combined or configured differently as shown in FIG. 3 for realizing examples disclosed herein.

Temperature parameter acquisition module 306 is configured to acquire a printhead temperature parameter 310 indicative of a temperature at the printhead.

In some examples herein, the acquisition of printhead temperature parameter 310 is a predictive acquisition. More specifically, acquired printhead temperature parameter 310 may be a print parameter correlated with the temperature that a printhead may have during printing of an outstanding image portion. As illustrated in FIG. 3, an outstanding image portion 314 may be an image portion corresponding to one or more print swaths 222 to be printed subsequently, i.e., downstream of an actual position 316 of printhead 202 over print media 108. As further set forth below with respect to FIG. 5, outstanding image portion 314 must not necessarily correspond to one or more print swaths.

As set forth above, the amount of ink to be ejected by a printhead for printing an image portion is indicative of the printhead temperature, or at least a printhead temperature increase, to be reached by the printhead for printing that image portion. For acquiring such a predictive temperature parameter, module 306 may access a counting function 308 provided by a density count engine (not shown). Density counting function 308 is configured to provide an estimate of the amount of print fluid to be printed in the outstanding image portion (e.g., one or more outstanding print swaths) via the set of nozzles for which the determination is being performed (e.g., nozzles in a printhead for a specific print fluid). In such examples, determination module 306 performs the determination based on, at least, the estimate of the amount of print fluid to be printed such as further illustrated below with respect to FIG. 6.

It will be understood that there are a variety of alternatives for implementing such a density count engine and density counting function 308. The density count engine to provide density counting function 308 may be provided as part of an ASIC and density counting function 308 may be implemented as a programmed function in the ASIC. In another example, density counting function 308 may be implemented as a programmed routine in a digital signal processor (DSP).

In some examples herein, acquisition of printhead temperature parameter 310 is a reactive acquisition and corresponds to actual values of printhead temperature. For example, as illustrated in FIG. 3, temperature parameter acquisition module 306 may acquire a sensor measurement 309 provided by a temperature sensor (not shown in FIG. 3), e.g., temperature sensor 224 illustrated above with respect to FIG. 2.

Examples herein may use more than one temperature parameter to correct alignment settings as described. For example, counting function 308 and sensor measurement may be acquired to validate each other. Further, both acquisitions provide data redundancy that prevents system failure in case that a component fails.

Alignment correction module 312 is configured to correct alignment of printhead 316 with respect to print media 108 based on printhead temperature parameter 310. For example, alignment correction module 312 may access a data store 318 storing alignment parameters in the form of alignment settings 316.

Alignment correction module 312 may perform the alignment correction by modifying alignment settings 316 according to acquired printhead temperature parameter 310. In some examples, data store 318 includes temperature-alignment look-up tables (LUTs) 317 correlating values of printhead temperature parameter 310 (e.g., values of counting function 308 and/or sensor measurement 309) with alignment of printhead 316. Temperature-alignment LUTs may be predetermined by measuring or simulating how printhead temperature affects printhead alignment. An example of such a measurement is set forth below with respect to FIG. 7.

Alignment correction module 312 may validate the acquired printhead temperature parameter 310 with a corresponding look-up table in temperature-alignment look-up tables 317. If the resulting alignment does not correspond to the currently stored alignment setting 316, alignment correction module 312 may modify alignment settings 316 to set the resulting alignment as the alignment to be applied for printing a subsequent image portion 314.

Printing module 313 is configured to print image portion 314 by actuation of printhead 316 according to the corrected alignment. More specifically, printing module 313 may process a print mask according to alignment settings 316 such that dot placement by nozzles in printhead 316 take into account dynamically corrected alignment between print media 108 and printhead 316.

It will be appreciated that examples above can be realized in the form of hardware, programming or a combination of hardware and the software. Any such software, which includes machine-readable instructions, may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of a tangible computer-readable storage medium that are suitable for storing a program or programs that, when executed, for example by a processor, implement embodiments. Accordingly, embodiments provide a program comprising code for implementing a system or method as claimed in any preceding claim and a tangible or intangible computer readable storage medium storing such a program. A tangible computer-readable storage medium is a tangible article of manufacture that stores data. (It is noted that a transient electric or electromagnetic signal does not fit within the former definition of a tangible computer-readable storage medium.)

Figure 4:
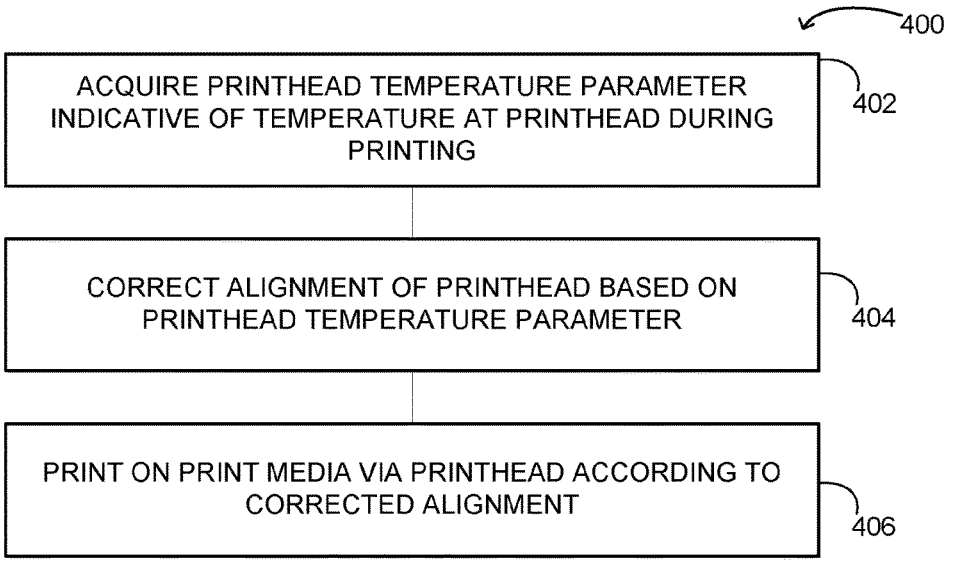
FIGS. 4 and 5 are block diagrams illustrating printer operation according to examples herein.
Figure 5:
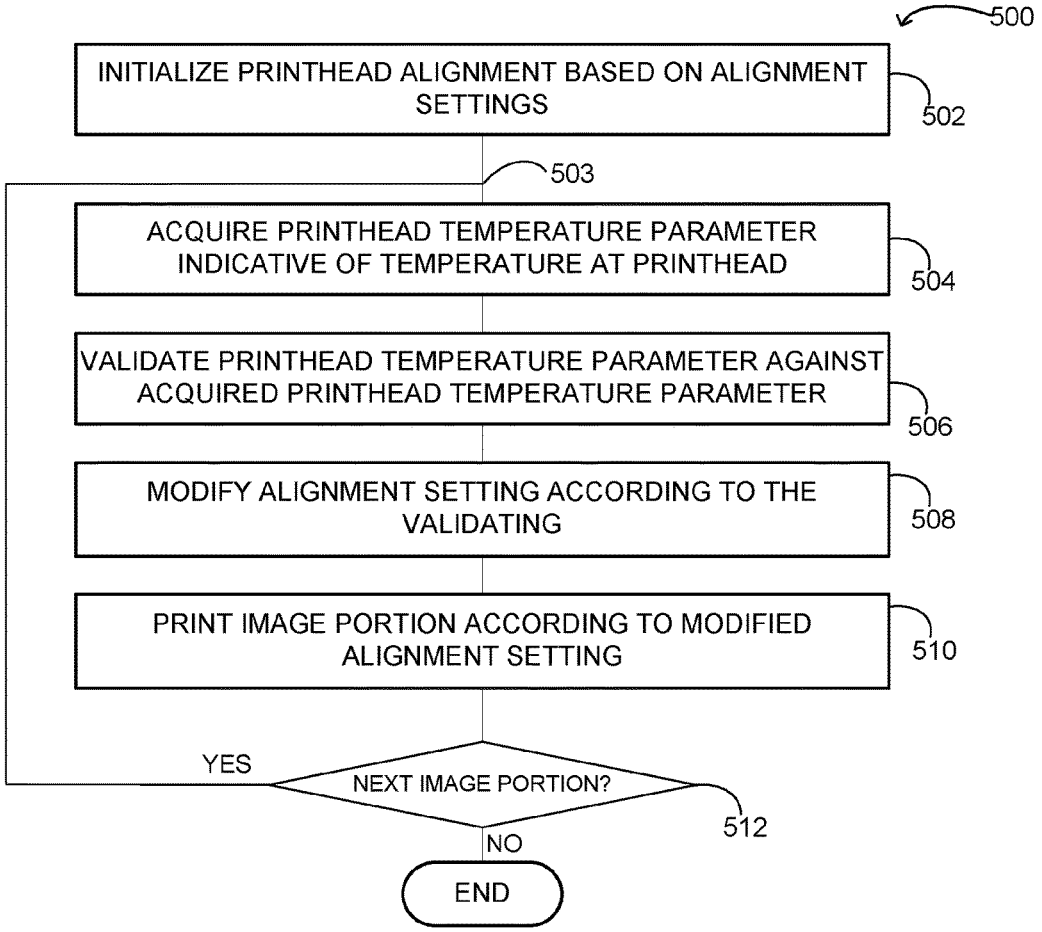

OPERATIONS: FIGS. 4 and 5 show flow charts for implementing at least some of the examples disclosed herein. In discussing FIGS. 4, 5 reference is made to FIGS. 1 to 3 to provide contextual examples. Implementation, however, is not limited to those examples. Reference is also made to the examples depicted in FIGS. 6 and 7. Again, such references are made simply to provide contextual examples.

FIG. 4 shows a flow chart 400 that implements examples of printer operation for printing an image on a print media by operation of a printhead to eject a print fluid over the print media. Blocks in flow chart 400 may be executed by controller 148, shown in FIG. 1 or, more specifically, by the physical and logical components illustrated above with respect to FIG. 3.

At block 402, a printhead temperature parameter indicative of a temperature at the printhead is acquired during printing. For example, referring to FIG. 3, printhead temperature parameter 310 may be acquired via temperature parameter acquisition module 306.

In at least some examples herein, the printhead temperature parameter is a print fluid amount to be ejected by a printhead to print at least an image portion (the temperature at the printhead is correlated to the print fluid amount, as set forth above). The print fluid amount may correspond to counting function 308 (see FIG. 3), which can be provided by a density count engine. An example of such a counting function is illustrated in some detail with respect to FIG. 6 below. It will be understood that the printhead amount may be acquired in alternative manners, for example it may correspond to a drop number or an absolute quantity of print fluid (e.g., ml) to be ejected by the printhead for printing an image portion.

In at least some examples herein, the printhead temperature parameter is a printhead temperature value acquired from a temperature sensor. For example, as illustrated in FIGS. 1 and 2, controller 148 or, more specifically, printhead temperature parameter engine 109 may acquire a measured printhead from temperature sensor 224.

In some examples herein, acquiring a temperature parameter may include acquisition of multiple parameters related to printhead temperature. For example, a printer may include both a density count engine and a printhead temperature sensor. Density counts and printhead temperature may be used to validate each other and/or to provide redundancy in case that the density count engine or the printhead temperature sensor fails during printer operation.

At block 404 the printhead alignment is corrected based on printhead temperature parameter. It will be understood that there are a variety of manners of performing printhead alignment correction. Some examples thereof are illustrated in further detail with respect to FIG. 5.

At block 406, printing is performed on the print media according to the alignment as corrected at block 406. Thereby it is facilitated compensation of temperature variations that might affect printhead alignment. Printing at block 406 may be performed in a bidirectional mode. Thereby, the printhead ejects print fluid drops while being displaced on a forward direction and a backward direction over a print media section. The corrected printhead alignment is then to prevent a bidirectional dot placement error caused by variation of printhead temperature.

According to some examples herein, the correcting at block 404 is performed during printing the image. Thereby, printhead alignment is corrected dynamically for compensating temperature variations during printing of an image. Dynamic printhead alignment is illustrated in further detail below with respect to FIG. 5.

FIG. 5 shows a flow chart 500 that implements examples of printer operation for printing an image on a print media by operation of a printhead to eject a print fluid over the print media. Blocks in flow chart 400 may be executed by controller 148, shown in FIG. 1 or, more specifically, by the physical and logical components illustrated above with respect to FIG. 3.

At block 502 printhead alignment is initialized based on alignment settings. For example, alignment settings might be generated by performing an alignment calibration of the printhead. A predetermined calibration pattern might be printed and the positioning of features in the calibration pattern might be measured to assess the correspondence between nozzle firing and drop placement. From this correspondence, the printhead alignment at an initial state of the printer may be inferred. Such initial settings may be associated with a printhead temperature at an initialization state of the printer. For example, the printhead temperature may be selected to be an average temperature during printing. A printhead setting may be initialized for each printhead in the printing system. In other words, each printhead in the printing system may be associated with its own printhead setting.

The alignment settings might be stored in a data file that is accessible during printing for alignment correction. While printing, the alignment settings are used to determine when nozzles in the printhead are to be fired so as to facilitate that print fluid drops are placed at desired positions on the print media.

At point 503, flow chart 500 starts the sequence for printing an image portion, e.g. any of image portions 314 depicted to in FIG. 3. The image portion must not necessarily correspond to a print swath. It might correspond to one or more print swath or dimensioned differently. For example, correction of printhead alignment according to examples herein may be applied only to certain printing areas in which it is expected to have temperature increases such as print areas more densely filled. Alternatively, or in addition thereto, the image portion may correspond to selected printing time period or size of printed areas.

At block 504, a printhead temperature parameter is acquired, which is indicative of a temperature at the printhead. Block 504 may be implemented analogously as set forth above for block 402 of flow chart 400, depicted in FIG. 4. As set forth above the acquired printhead temperature may be reactive (e.g., a print fluid amount to print an outstanding image portion) or reactive (e.g. an actual measurement of printhead temperature).

At block 506, the alignment settings are validated against the printhead temperature parameter acquired at block 504. Generally, this includes checking which alignment settings correspond to the acquired temperature parameter. There are a variety of options for performing the validating at block 506. In an example, the validating at block 506 includes accessing a look-up table (LUT) relating printhead temperature parameter values with alignment settings. For example, referring to the example in FIG. 3, alignment correction module 312 may infer which alignment settings correspond to an acquired printhead temperature parameter by accessing temperature alignment LUTs 317 in data store 318. Alternatives for the validating at block 506 include, for example, accessing a predetermined function relating alignment settings with values of the printhead temperature parameter.

For the validating at block 506, a predetermined correspondence between alignment settings and printhead temperature may be used. This predetermination may be performed by printing a determined pattern at different temperatures without varying alignment settings and measure the deviations in the printed pattern from an expected pattern (i.e., a pattern with a correct alignment). For example, looking at FIG. 7, a pattern 700 may be printed on a print media 108 using a bidirectional mode. That is, for printing pattern 700, print fluid drops are ejected both in a forward direction 110 and a backward direction 112. Each line 700*a*-700*d* is printed with a different printhead assigned to a specific print fluid.

Pattern 700 may be printed varying printhead temperatures for assessing variation in the printhead alignment and, hence, determining alignment setting for different temperatures. Printhead temperature may be varied in a selectable manner using a variety of techniques. In one of these techniques, referred to as trickle warming, a closed loop may be implemented in which a target temperature is controlled by actuating the nozzle resistors.

Printhead alignment may be measured as an error between the printed pattern and the expected pattern. The error measurement may be performed manually using precision magnifying lenses or automatically by using image acquisition equipment. By varying the temperature, the following table might be generated relating printhead temperature and alignment error:

TABLE 1

| Printhead Temperature | Alignment error |
|---|---|
| 40° C. | 0 dots @600 dpi |
| 45° C. | 0 dots @600 dpi |
| 50° C. | 2 dots @600 dpi |
| 55° C. | 4 dots @600 dpi |
| 60° C. | 6 dots @600 dpi |

As it can be observed from table 1, from a certain temperature, the alignment error increases linearly. From the measured errors, the correct alignment settings for a specific temperature can be derived straightforwardly and correspond to a time delay for firing the printheads with respect to the initial alignment settings. Values for intermediate temperatures might be generated by interpolation.

Referring back to FIG. 5, at block 508 the alignment settings are modified according to the validating at block 506. For example, referring to FIG. 3, if it is inferred from the validation at block 506 that the alignment settings are to be varied in view of an expected alignment, alignment correction module 312 may cause changes in alignment settings 316 corresponding to the validation of an acquired printhead temperature parameter 310 with temperature-alignment LUTs 317.

Blocks 504 to 510 may be applied to each printhead in the print system so that printhead alignment can be corrected for each printhead individually. This might be in particular convenient since different print fluids may behave differently for the same temperature variation. For example, ejection speed for different print fluids may be differently affected by temperature changes. As set forth above, print fluid ejection speed is one of the factors affecting printhead alignment.

Further blocks 504 to 510 may be performed to compensate for temperature differently across a printhead. In particular, in at least some examples herein the correcting may be performed for a set of nozzles in a printhead. For example, the acquisition at block 504 may be performed for different sections at a printhead; it might be then determined that different portions at the printhead are subjected to different temperature variations; the validation at block 506 and the modification alignment at block 508 may be then performed differently for different sets of nozzles at the printhead so that the temperature variations at the different sections of the printhead are compensated differently.

At block 510, an image portion is printed according to the alignment setting modified at block 508. Thereby, dynamic variation of printhead alignment is implemented to respond to temperature variations during printing.

At block 512, it is assessed whether further image portions are outstanding for printing. If at least one further image portion is outstanding, flow chart 500 goes back to point 503 and blocks 504 to 510 are executed for the next image portion. If no further image portions are outstanding, the printing of the image is finished.

In some examples herein, the validating at block 506 and the modification at block 508 might be performed only if printhead temperature parameter at block 504 indicates a variation in printhead temperature. In other words, if it is assessed at block 504 that there is no temperature variation of the printhead, blocks 506 and 508 may be skipped.

Figure 6:
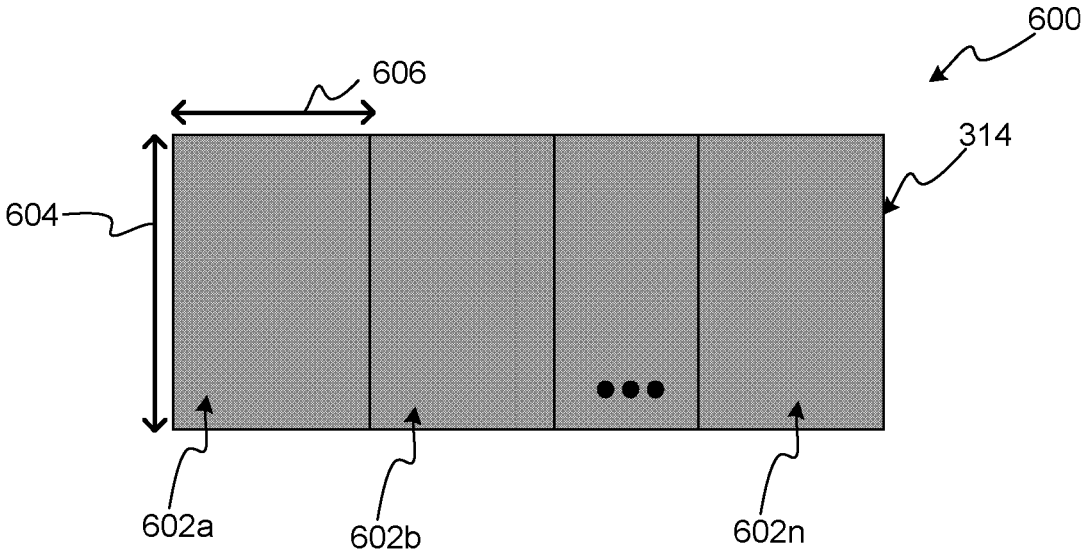
FIG. 6 is a block diagram illustrating how a print density counting function can be evaluated according to examples herein.

As mentioned above, a printhead temperature parameter used for printhead alignment as described herein may correspond to an amount of print fluid to be ejected and, more specifically to a print density counting function. FIG. 6 illustrates an example of how a print density counting function 600 might be defined for determining whether servicing of nozzles is required for printing an outstanding image portion.

In the illustrated example, print density counting function 600 may consist of the amount of print fluid to be ejected for an outstanding image portion 314 and per print fluid type. For example, function 600 may provide an ink amount to print a specific color in the next print swath. This amount might be made available from an ASIC module. The ASIC might provide a density function by counting the number of times that a hifipe level occurs in each density counting region 602*a*-602*n*. A hifipe level refers to the halftoning level for a specific pixel (the halftoning level is generally proportional to the number of drops to be ejected).

Each density counting region 602*a*-602*n* is defined by a region height 604 and a region width 606. The height 604 of the region in which the density function is to be evaluated might be selected as the height of the outstanding swath. The region width 606 may be programmable. For example, the region width 606 can be set to 64, 128, 256 or 512 pixels. A count value may be stored for each densitometer region 602*a*-602*n* so that an outstanding image portion for performing the servicing determination set forth above may be a portion of a print swath. Evaluation of density function 600 may be performed for both input and output planes. Thereby, values for density function 600 may be obtained both for a precedent image portion and a subsequent image portion.

In the foregoing description, numerous details are set forth to provide an understanding of the examples disclosed herein. However, it will be understood that the examples may be practiced without these details. While a limited number of examples have been disclosed, numerous modifications and variations therefrom are contemplated. It is intended that the appended claims cover such modifications and variations. Further, flow charts herein illustrate specific block orders; however, it will be understood that the order of execution may differ from that which is depicted. For example, the order of execution of two or more blocks may be scrambled relative to the order shown. Also, two or more blocks shown in succession may be executed concurrently or with partial concurrence. Further, claims reciting "a" or "an" with respect to a particular element contemplate incorporation of one or more such elements, neither requiring nor excluding two or more such elements. Further, at least the terms "include" and "comprise" are used as open-ended transitions.

What is claimed is:

1. A method for printing an image on a print media by operation of a printhead to eject a print fluid over the print media, comprising:

acquiring a printhead temperature parameter indicative of a temperature at the printhead during printing, wherein the printhead temperature parameter is a print fluid amount to be ejected by the printhead to print at least an image portion, the temperature at the printhead being correlated to the print fluid amount;

correcting alignment of the printhead based on the printhead temperature parameter; and printing on the print media via the printhead according to the corrected alignment.

2. The method of claim 1, wherein the printhead temperature parameter is a printhead temperature value acquired from a temperature sensor.

3. The method of claim 1, wherein the correcting is performed for a set of nozzles in the printhead.

4. An inkjet printer for printing an image on a print media by operation of a printhead, the printer comprising:

a controller to control the printhead to print an image portion by causing, while an image is being printed:

acquisition of a printhead temperature parameter indicative of a temperature at the printhead, wherein the printhead temperature parameter is a print fluid amount to be ejected by the printhead to print at least an image portion, the temperature at the printhead being correlated to the print fluid amount;

correction of alignment of the printhead with respect to the print media based on the acquired printhead temperature parameter; and printing the image portion by actuation of the printhead according to the corrected alignment.

5. The inkjet printer of claim 4 further comprising a temperature sensor for measuring a printhead temperature, the printhead temperature parameter corresponding to the sensor measurement.

6. The inkjet printer of claim 4 further comprising an engine providing a print fluid density counting function providing an estimate of the amount of print fluid to be ejected by the printhead to print the image portion, the printhead temperature parameter corresponding to values of the print fluid density counting function, the temperature at the printhead being correlated to the print fluid amount.

7. The inkjet printer of claim 6, wherein the engine includes an application-specific integrated circuit module customized for providing the print fluid density counting function.

8. The inkjet printer of claim 4, further including a memory including stored alignment parameters, the correction of alignment including accordingly modifying the stored alignment parameters.

9. A computer software product comprising a tangible medium readable by a processor, the medium having stored thereon a set of instructions for operating a printer for printing an image by operation of a printhead, the instructions comprising:

a set of instructions which, when loaded into a memory and executed by the processor, store an alignment setting for the printhead;

a set of instructions which, when loaded into a memory and executed by the processor, causes initializing alignment of the printhead based on the stored alignment setting;

a set of instructions which, when loaded into a memory and executed by the processor, causes acquiring of a printhead temperature parameter indicative of a temperature at the printhead while an image is being printed, wherein the printhead temperature parameter is a predictive temperature parameter comprising a print fluid amount to be ejected by the printhead for printing an outstanding image portion, the temperature at the printhead being correlated to the print fluid amount;

a set of instructions which, when loaded into a memory and executed by the processor, causes validating the stored alignment settings against the acquired printhead temperature parameter;

a set of instructions which, when loaded into a memory and executed by the processor, causes, modifying the stored alignment setting according to the validating; and a set of instructions which, when loaded into a memory' and executed by the processor, causes printing the image portion according to the modified stored alignment setting.

10. The product of claim 9, wherein the validating includes accessing a look-up table relating printhead temperature parameter values with alignment settings.

11. The product of claim 9, wherein printhead alignment is to prevent a bidirectional dot placement error caused by a variation of printhead temperature.

12. The product of claim 9, wherein the printhead temperature parameter is indicative of printhead temperature for printing the outstanding image portion.

13. The product of claim 9, wherein the printhead temperature parameter is a sensor measurement indicative of an actual printhead temperature.

14. The method of claim 1, wherein acquiring a printhead temperature parameter, and correcting alignment of the printhead are carried out multiple times during a printing of an image.

15. The method of claim 1, wherein acquiring the printhead temperature parameter includes acquiring multiple printhead temperature parameters for a printhead.

16. The inkjet printer of claim 4, wherein acquisition of a printhead temperature parameter and correction fo alignment of the printhead based on the acquired printhead temperature parameter are carried out for each portion of an image.

17. The inkjet printer of claim 4, wherein the controller compensates for temperature variations during printing of an image.

18. The method of claim 1, wherein correction of alignment of the printhead is applied just to print areas expected to have temperature increases.

* * * * *